US011505994B2

(12) United States Patent
Foley et al.

(10) Patent No.: US 11,505,994 B2
(45) Date of Patent: Nov. 22, 2022

(54) TOP CAP FOR MULTI-POSITION LADDER

(71) Applicant: Tricam Industries, Inc., Eden Prairie, MN (US)

(72) Inventors: Joseph P. Foley, St. Paul, MN (US); Benjamin P. Williams, Chaska, MN (US); Benjamin M. Wernberg, Savage, MN (US); Dennis D. Simpson, Plymouth, MN (US)

(73) Assignee: Tricam Industries, Inc., Eden Prairie, MN (US)

( * ) Notice: Subject to any disclaimer, the term of this patent is extended or adjusted under 35 U.S.C. 154(b) by 432 days.

(21) Appl. No.: 16/654,699

(22) Filed: Oct. 16, 2019

(65) Prior Publication Data

US 2020/0115961 A1 Apr. 16, 2020

Related U.S. Application Data

(60) Provisional application No. 62/746,278, filed on Oct. 16, 2018.

(51) Int. Cl.

| | |
|---|---|
| ***E06C 7/48*** | (2006.01) |
| ***E06C 1/20*** | (2006.01) |
| ***E06C 1/39*** | (2006.01) |
| ***E06C 1/08*** | (2006.01) |

(52) U.S. Cl.

CPC ..... *E06C 7/48* (2013.01); *E06C 1/08* (2013.01); *E06C 1/20* (2013.01); *E06C 1/39* (2013.01)

(58) Field of Classification Search

CPC ..... E06C 7/48; E06C 1/08; E06C 1/20; E06C 1/39; E06C 1/393; E06C 1/387; E06C 1/18; E06C 1/32; E06C 1/38; E06C 1/14

USPC ..... 182/194

See application file for complete search history.

(56) References Cited

U.S. PATENT DOCUMENTS

| | | | | | |
|---|---|---|---|---|---|
| 181,305 | A * | 8/1876 | Bitter | E06C 1/12 | 182/24 |
| 1,936,508 | A * | 11/1933 | Hanly | E06C 1/32 | 182/24 |
| 3,430,972 | A * | 3/1969 | Armin | B62B 1/12 | 182/20 |
| 3,692,143 | A * | 9/1972 | Kummerlin | E06C 1/12 | 182/24 |
| 3,912,043 | A * | 10/1975 | Brannan | E06C 1/32 | 182/23 |
| 4,182,431 | A * | 1/1980 | Wing | E06C 1/32 | 182/228.1 |

(Continued)

*Primary Examiner* — Colleen M Chavchavadze
*Assistant Examiner* — Shiref M Mekhaeil

(57) ABSTRACT

An multi-position ladder is disclosed that includes an adjustable top cap that provides a tool or material tool tray when the ladder is in a stepladder position and provides a step when the ladder is in an extension ladder position is disclosed. The top cap generally comprises a rigid frame extending between the adjustable hinges of the multi-position ladder with a tool or utility tray and a step surface on opposing sides. The tool tray is parallel to the ladder rungs when the ladder is in a stepladder position, and the step surface provides a generally planar surface parallel the rungs when the ladder is in an extension position. The rigid frame of the top cap adds strength to the adjustment hinge and to the multi-position ladder. Embodiments allow for 12-inch hinge spacing, adding one foot reach in the extension position and six inch reach to the stepladder.

20 Claims, 17 Drawing Sheets

(56) References Cited

U.S. PATENT DOCUMENTS 4,371,055 A * 2/1983 Ashton ..... E06C 7/081 182/194
4,376,470 A * 3/1983 Ashton ..... E06C 7/08 182/228.2
4,483,415 A * 11/1984 Disston ..... E06C 1/22 182/156
4,520,896 A * 6/1985 Disston ..... E06C 1/22 182/156
4,666,328 A * 5/1987 Ryu ..... E06C 1/32 403/92
4,697,305 A * 10/1987 Boothe ..... E06C 1/32 16/349
4,770,559 A * 9/1988 Yoo ..... F16C 11/10 403/324
4,890,950 A * 1/1990 Yoo ..... F16C 11/10 182/163
4,951,780 A * 8/1990 Kim ..... E06C 1/22 182/27
4,989,692 A * 2/1991 Min ..... E06C 1/39 182/24
5,142,739 A * 9/1992 Lin ..... E05D 11/1007 16/326
5,620,272 A * 4/1997 Sheng ..... E06C 1/32 403/92
5,873,433 A * 2/1999 Katz ..... E06C 7/14 248/210
5,954,157 A * 9/1999 Grimes ..... E06C 1/32 16/329
5,971,102 A * 10/1999 Brown ..... E06C 7/084 206/372
6,000,497 A * 12/1999 Kain ..... E06C 7/14 248/238
6,343,406 B1 * 2/2002 Yeh ..... E06C 1/32 182/163
6,443,261 B1 * 9/2002 Gibson ..... E06C 7/14 182/104
6,536,557 B2 * 3/2003 Gibson ..... E06C 7/14 182/161
6,711,780 B2 * 3/2004 Lee ..... E06C 1/32 16/334
6,857,503 B2 * 2/2005 Simpson ..... E06C 7/083 182/178.3
7,007,344 B2 * 3/2006 Lee ..... E06C 1/32 403/68
7,032,711 B1 * 4/2006 Katz ..... B25H 3/06 248/238
7,047,597 B2 * 5/2006 Lee ..... E06C 1/32 16/233
7,140,072 B2 * 11/2006 Leng ..... E06C 1/32 16/326
7,264,082 B2 9/2007 Simpson et al.
7,306,075 B2 * 12/2007 Winslow ..... E06C 1/18 182/163
7,364,017 B2 * 4/2008 Moss ..... E06C 1/22 182/163
7,370,726 B1 * 5/2008 Chavez ..... E06C 1/18 248/210
7,424,933 B2 * 9/2008 Weiss ..... E06C 7/42 182/163
8,262,124 B2 * 9/2012 Longenecker ..... B62B 9/26 280/658
8,651,259 B1 * 2/2014 Blehm ..... E06C 7/50 182/178.3
10,138,680 B2 * 11/2018 Williams ..... E06C 7/14
10,233,692 B2 * 3/2019 Kieffer ..... E06C 1/125
10,648,234 B2 * 5/2020 Skubic ..... E06C 1/393
10,718,160 B2 * 7/2020 Leng ..... E06C 1/10
2003/0012595 A1 * 1/2003 Park ..... E06C 1/32 403/84
2003/0217888 A1 * 11/2003 Simpson ..... E06C 1/20 182/163
2004/0129497 A1 * 7/2004 Weiss ..... E06C 1/32 182/163
2009/0078503 A1 * 3/2009 Eriksson ..... E06C 1/22 182/104
2014/0251729 A1 * 9/2014 Parker ..... E06C 1/393 182/129
2015/0068842 A1 * 3/2015 Moss ..... E06C 1/32 292/341.15
2016/0153231 A1 * 6/2016 Kieffer ..... E06C 1/383 182/163
2017/0145745 A1 * 5/2017 Kieffer ..... E06C 7/42
2017/0356244 A1 * 12/2017 Peterson ..... E06C 1/10
2019/0136625 A1 * 5/2019 Chen ..... F16B 7/044
2019/0145170 A1 * 5/2019 Clark ..... E06C 7/06 182/104
2019/0234144 A1 * 8/2019 Badowski ..... C21D 9/04
2019/0368271 A1 * 12/2019 Lentine ..... E06C 1/22
2019/0376343 A1 * 12/2019 Maxfield ..... E06C 7/48

* cited by examiner

TOP CAP FOR MULTI-POSITION LADDER

RELATED APPLICATION INFORMATION

This application claims the benefit of U.S. Provisional Application No. 62/746,278, filed Oct. 16, 2018, the contents of which are fully incorporated herein by reference.

TECHNICAL FIELD

The present disclosure relates generally to a ladder. More particularly, the present invention relates to a top cap for a multi-position ladder providing a tool or material work surface when the ladder is in stepladder mode and providing a structurally sound, stable step when the ladder is in extension mode.

BACKGROUND

Portable ladders are commonly used for a variety of applications, with several different styles being used. The two best known designs are extension ladders, which must be leaned against a vertical surface for support, and step ladders, which are free standing. For some time it has been known that constructing ladders with two sections that are slidably mounted with respect to each other enables the overall length of the extension ladder to be varied depending upon the desired use of the extension ladder. This feature is particularly useful for transporting the ladder to a desired use location. However conventional extension ladders do not have the ability to stand up without being leaned against another object. In certain circumstances it is not possible to lean the extension ladder against other objects. To overcome this shortcoming, Kummerlin et al., U.S. Pat. No. 3,692,143, pivotally attaches two extension ladders together. This ladder retained the benefits of being able to adjust the height of the ladder while adding the benefit that the ladder could remain erect without leaning against other objects. Multi-position ladders have become very popular in recent years because of their versatility, and are being used for a variety of applications by members of the construction trade, maintenance personnel, and homeowners, among others.

Many improvements have been made to the design of multi-position ladders. Simpson et al., U.S. Pat. No. 6,857,503, is directed to a multi-position ladder that is versatile, light weight, and relatively low in cost. A common element of most multi-purpose ladders is the hinge assembly, which enables the adjustability of the ladder's position while also contributing to its stability while in a working position. Hinges in multi-position ladders are designed to ensure ease of adjustment between a step-ladder position and an extension ladder position. Generally, multi-position ladders do not have a top cap or a top step coupled to the hinge mechanism. The multi-position ladders disclosed by the prior art have a hinge at the top around which the ladder can rotate to adjust between a step ladder position and an extension ladder position. Thus, there is a need in the art for a top cap capable of providing a tool tray when the multi-position ladder is in a step ladder position and a step when the multi-position ladder is in an extension position.

SUMMARY OF THE DISCLOSURE

The present invention is directed to an improved top cap for a multi-position ladder that meets the objectives of low cost, durability, and safety. The top cap of the present invention provides a significant improvement over the prior art in terms of its ease of use, providing a rigid frame between hinges, improving the strength and durability of the hinges and the ladder. In one embodiment, the top cap includes a tool or material work surface when the ladder is in the stepladder position, and acts as a step when the ladder is in the extension ladder position.

Embodiments of the present invention may be a combination of a tool or material work surface and a step. The top cap can be manufactured of any formable durable material, such as metal, plastic, or fiberglass. Preferably, the tool or work surface can be made of plastic or other lightweight, inexpensive material while the stop portion is formed of aluminum or other heavy-duty, durable material. In alternative embodiments, the entirety of the top cap can be formed of a single material, such as plastic or aluminum.

In preferred embodiments, the stop portion may be connected to the hinges on each side of the multi-position ladder to add stiffness to the hinge and ladder and to provide a step when the ladder is in the extension position. The preferred embodiment further contemplates the tool or tool tray being attached to the step portion using rivets. The stop portion may be riveted or welded to the hinges, or may be extruded or otherwise formed as a part of the hinges.

The summary above is not intended to describe each illustrated embodiment or every implementation of the present disclosure. The figures and the detailed description that follow more particularly exemplify these embodiments.

BRIEF DESCRIPTION OF THE DRAWINGS

The disclosure can be more completely understood in consideration of the following detailed description of various embodiments of the disclosure, in connection with the accompanying drawings, in which.

Figure 1:
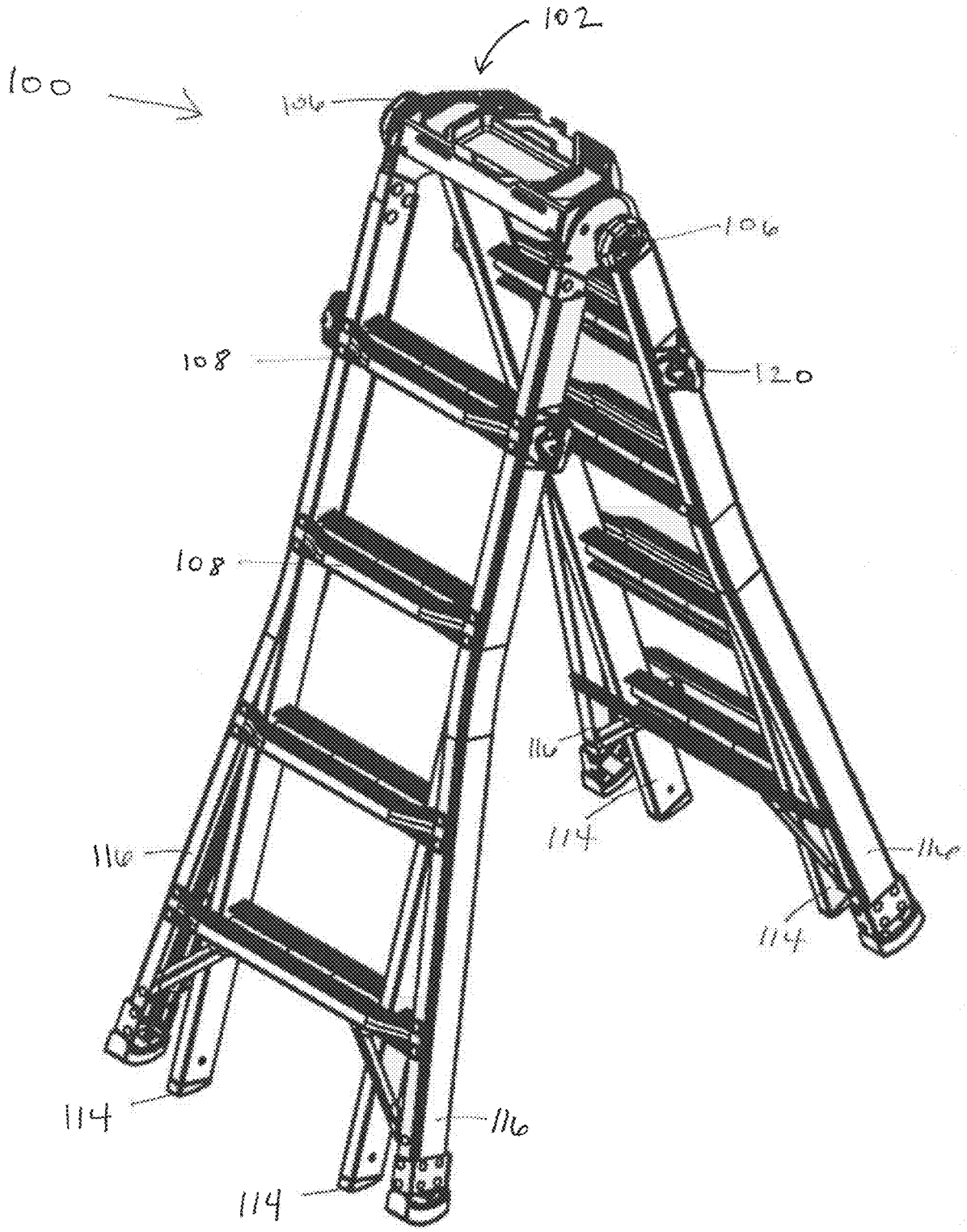
FIG. 1 is a perspective view of a multi-position ladder in a stepladder position according to an embodiment of the invention.
Figure 2:
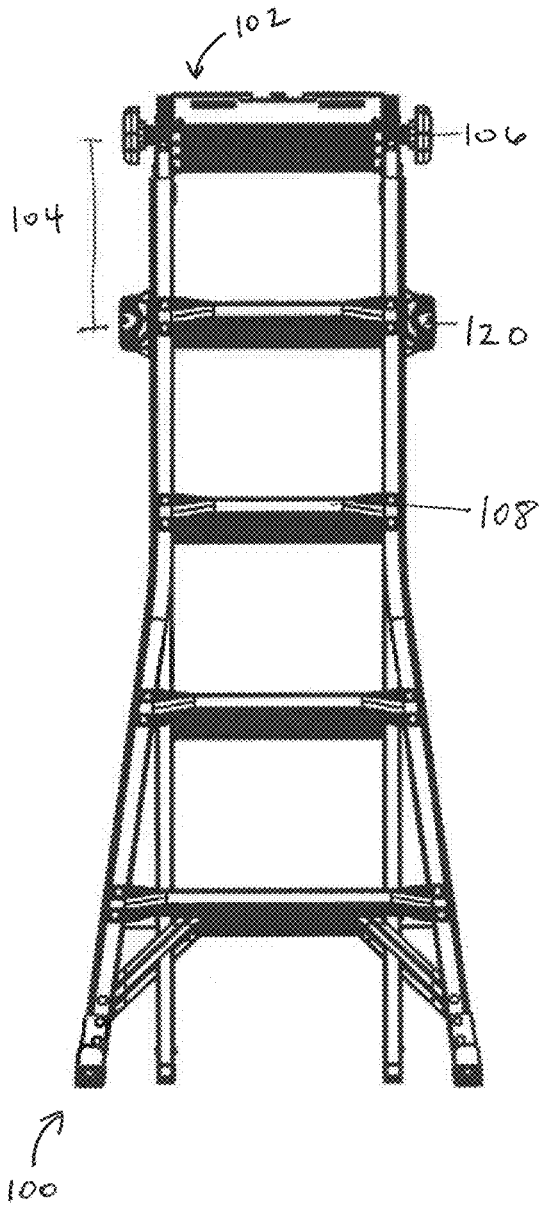
FIG. 2 is a front elevation view of the multi-position ladder according to the embodiment shown in FIG. 1.
Figure 3:
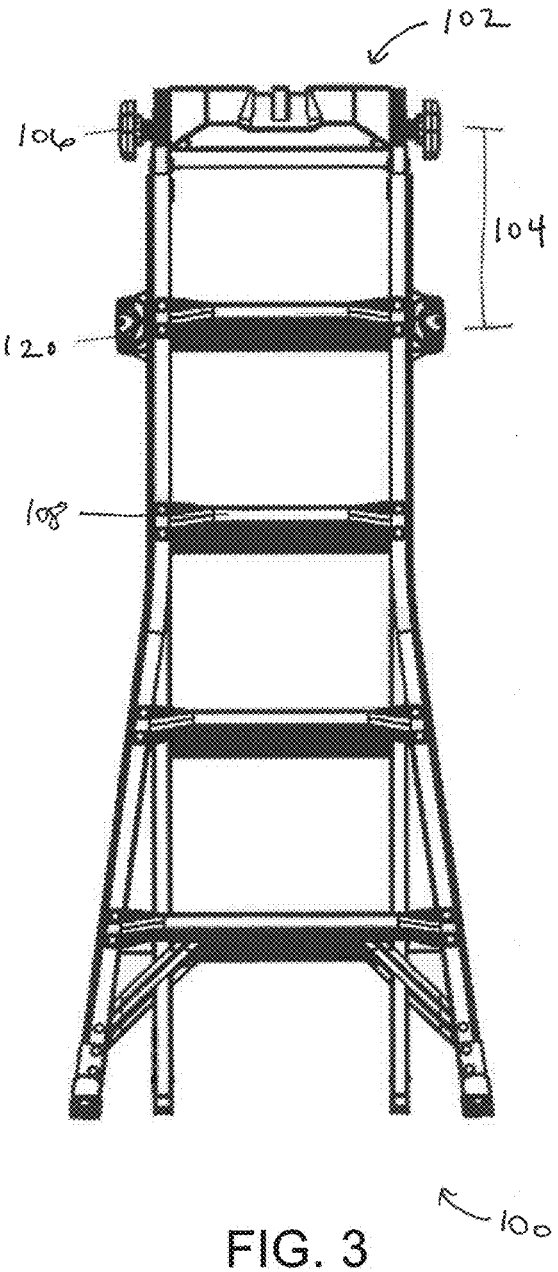
FIG. 3 is a rear elevation view of the multi-position ladder according to the embodiment shown in FIG. 1.
Figure 4:
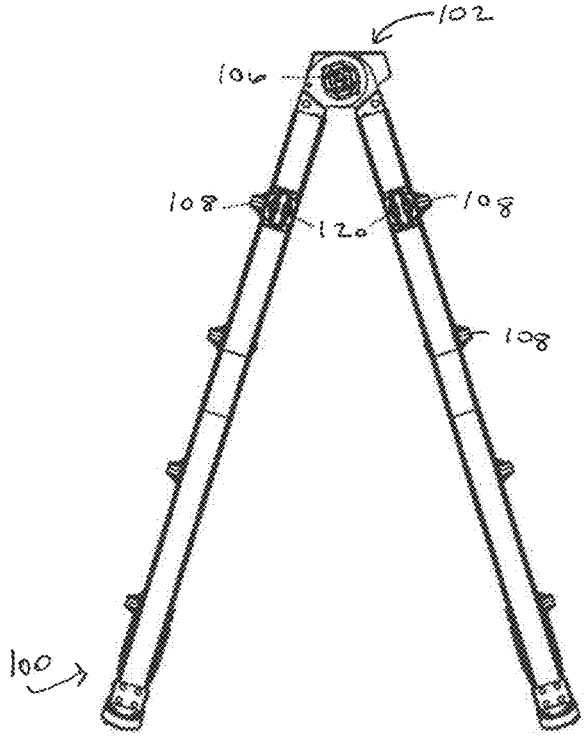
FIG. 4 is a side elevation view of the multi-position ladder according to the embodiment shown in FIG. 1.
Figure 5:
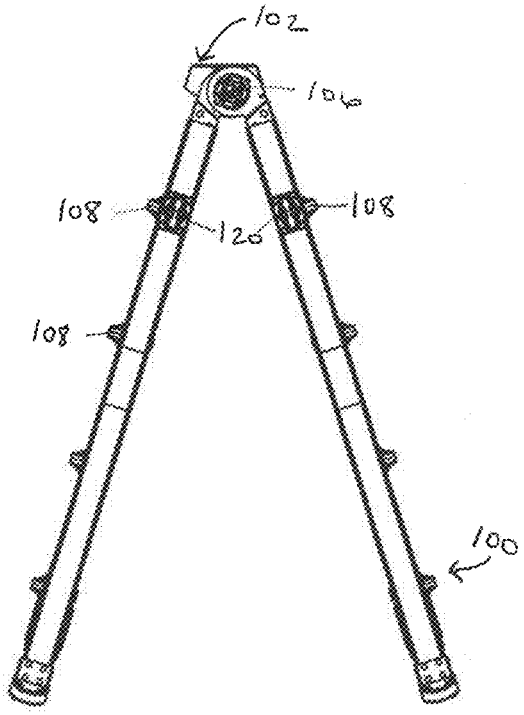
FIG. 5 is a side elevation view of the multi-position ladder according to the embodiment shown in FIG. 1.
Figure 6:
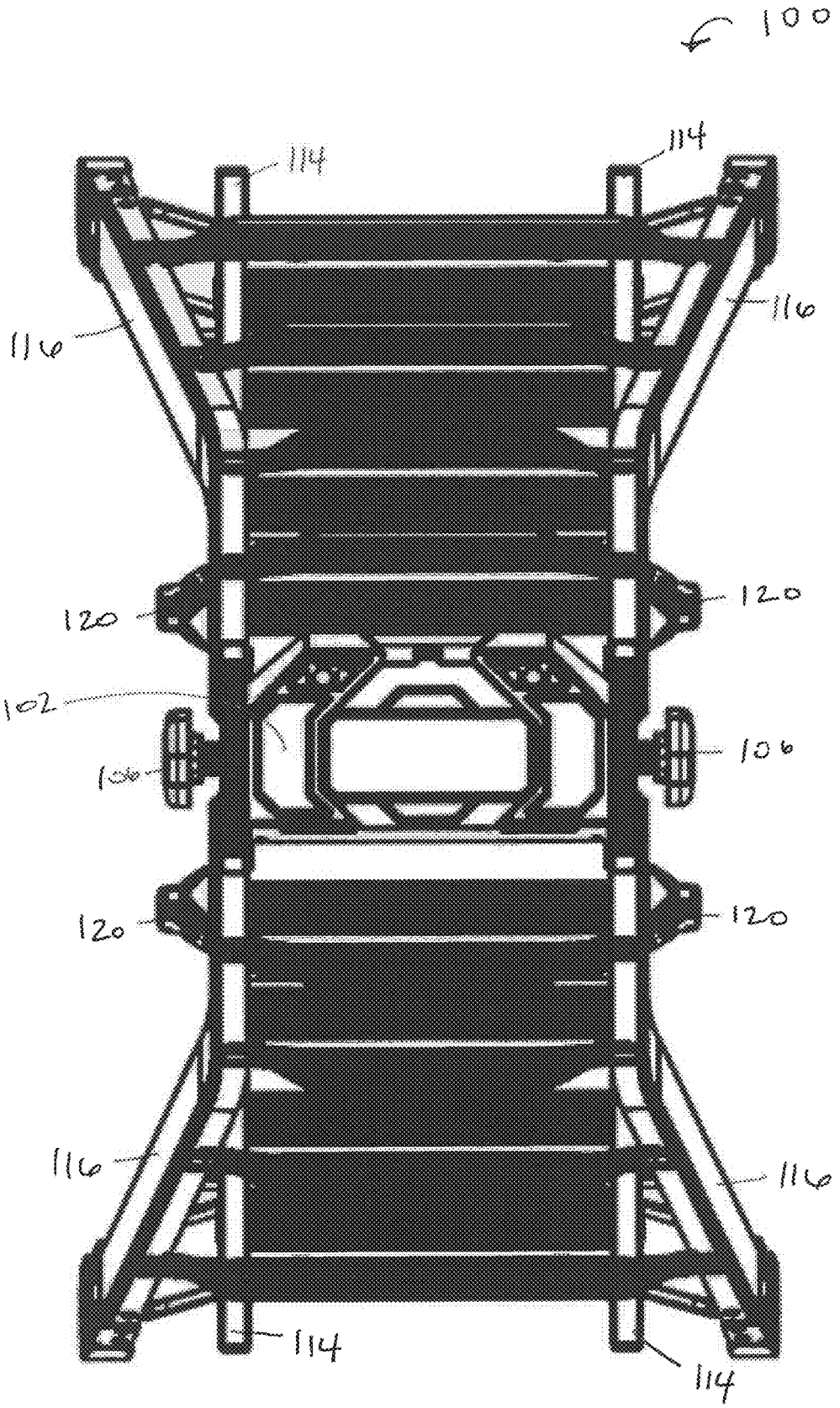
FIG. 6 is a top view of the multi-position ladder according to the embodiment shown in FIG. 1.

While embodiments of the disclosure are amenable to various modifications and alternative forms, specifics thereof shown by way of example in the drawings will be described in detail. It should be understood, however, that the intention is not to limit the disclosure to the particular embodiments described. On the contrary, the intention is to cover all modifications, equivalents, and alternatives falling within the spirit and scope of the subject matter as defined by the claims.

DETAILED DESCRIPTION

Preferred embodiments for the improved top cap for a multi-position ladder are a rigid frame between the adjustable hinges of a ladder capable of operating in multiple positions, for example, in a stepladder position and an extension ladder position. Construction and operation of such multi-position ladders is well known in the art. In embodiments, the multi-position ladder presently provided generally comprises two hinges, matably attached to four rails, the rails being attached to a plurality of rungs that provide stepping surfaces, and a top cap. According to this embodiment, each hinge 106 generally includes two hinge extensions 180 and an inside surface 190. The hinges 106 may be configured to adjust the multi-position ladder between a stepladder position 100 and an extension position 200. When the multi-position ladder is positioned in a stepladder position 100, the hinge extensions 180 of each hinge 106 may generally form an angle between zero degrees and 180 degrees. When the multi-position ladder is in an extension position 200, the rails 108 are generally coplanar.

Figure 13:
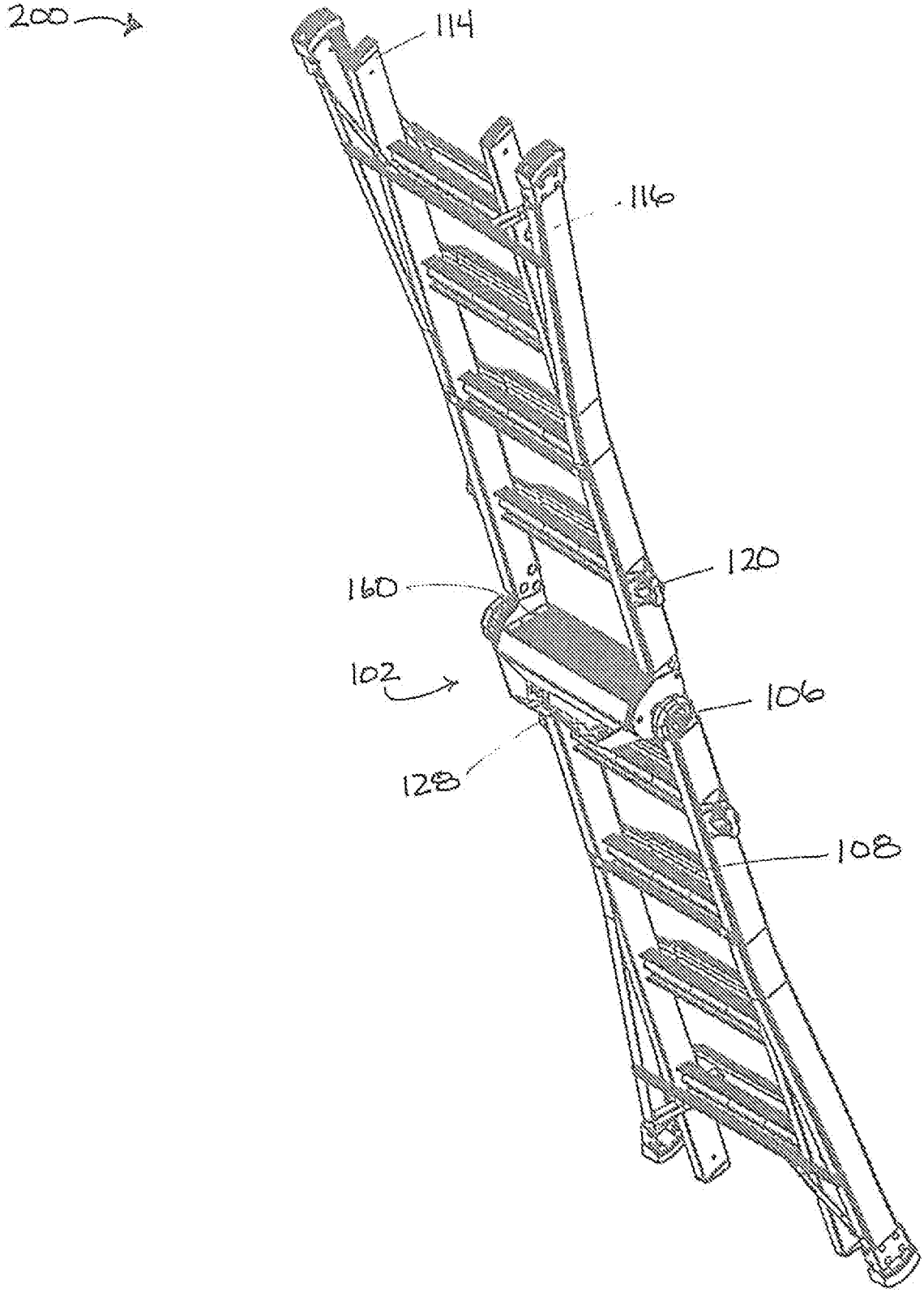
FIG. 13 is a perspective view of a multi-position ladder in an extension position according to an embodiment of the invention.
Figure 14:
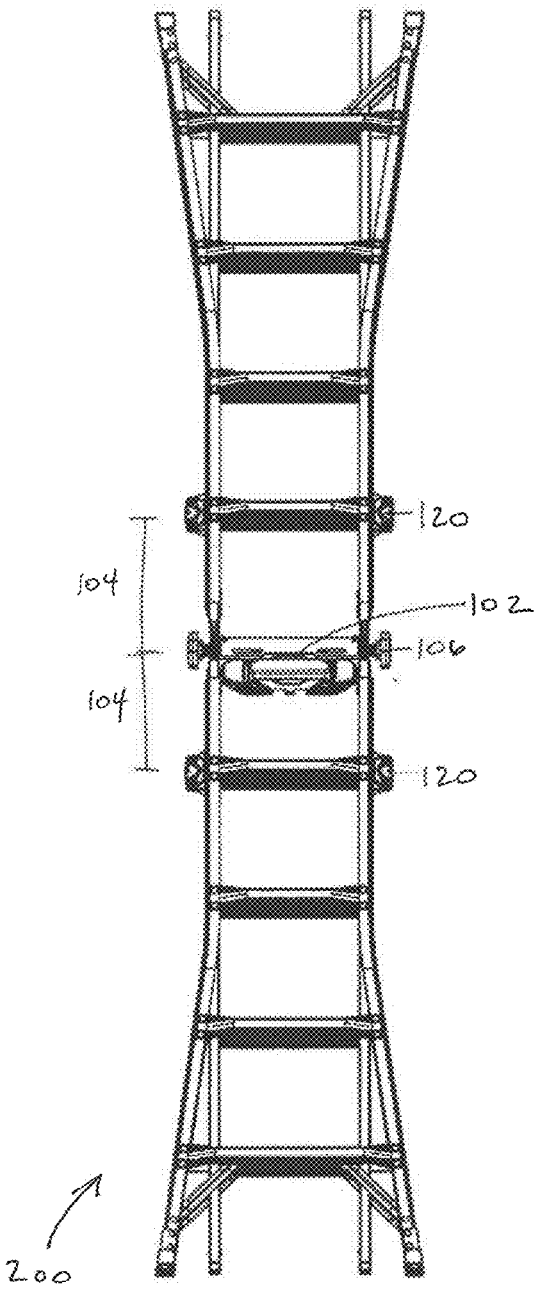
FIG. 14 is a front elevation view of the multi-position ladder according to the embodiment shown in FIG. 13.
Figure 15:
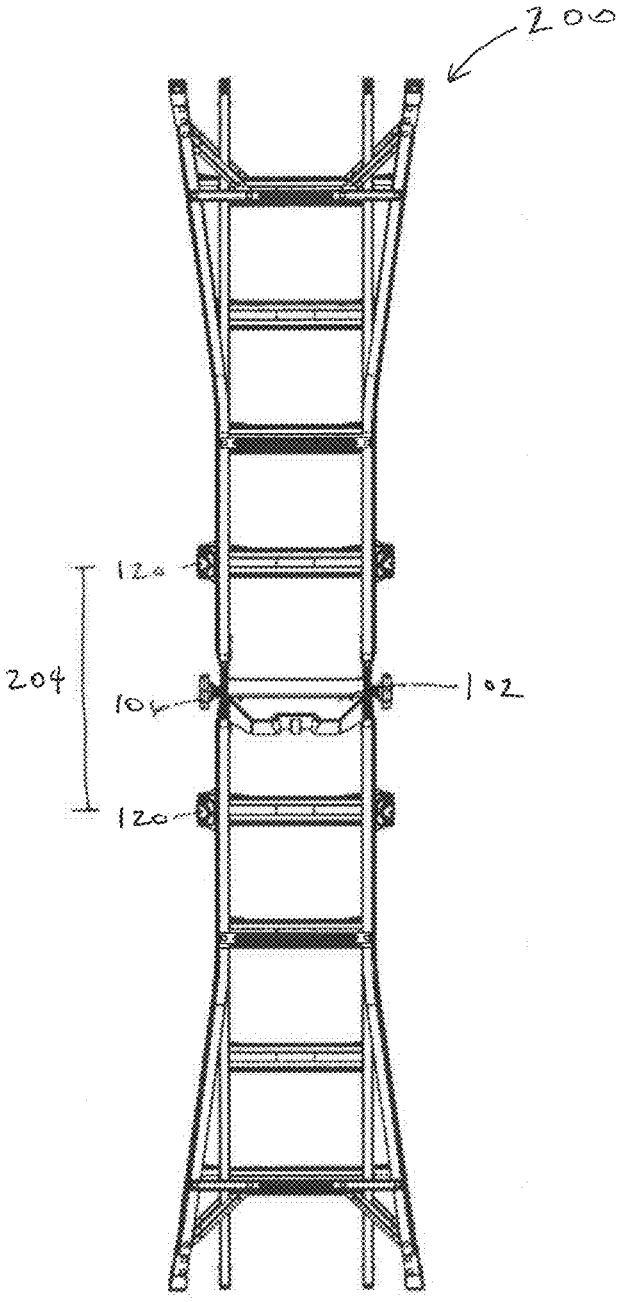
FIG. 15 is a rear elevation view of the multi-position ladder according to the embodiment shown in FIG. 13.
Figure 16:
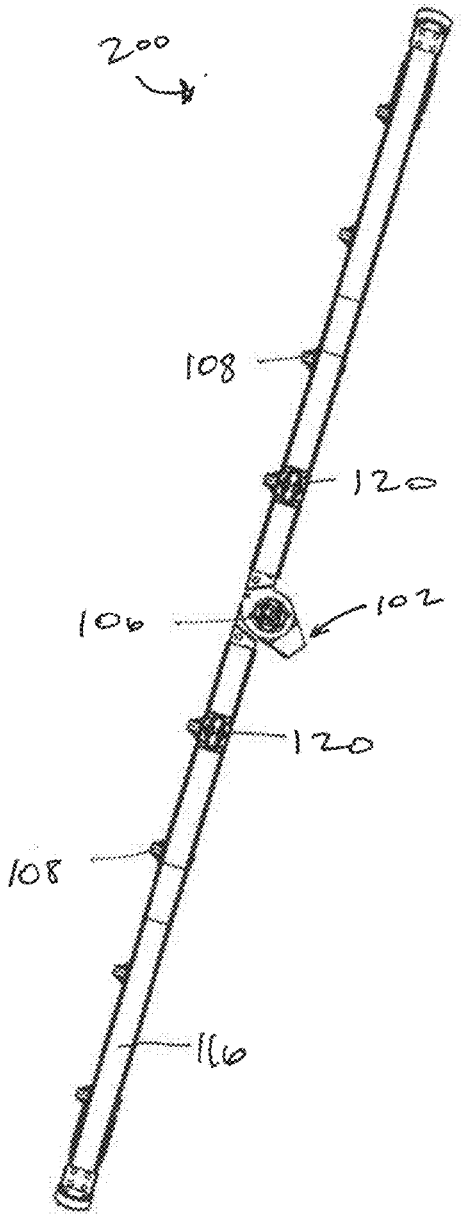
FIG. 16 is a side elevation view of the multi-position ladder according to the embodiment shown in FIG. 13.
Figure 17:
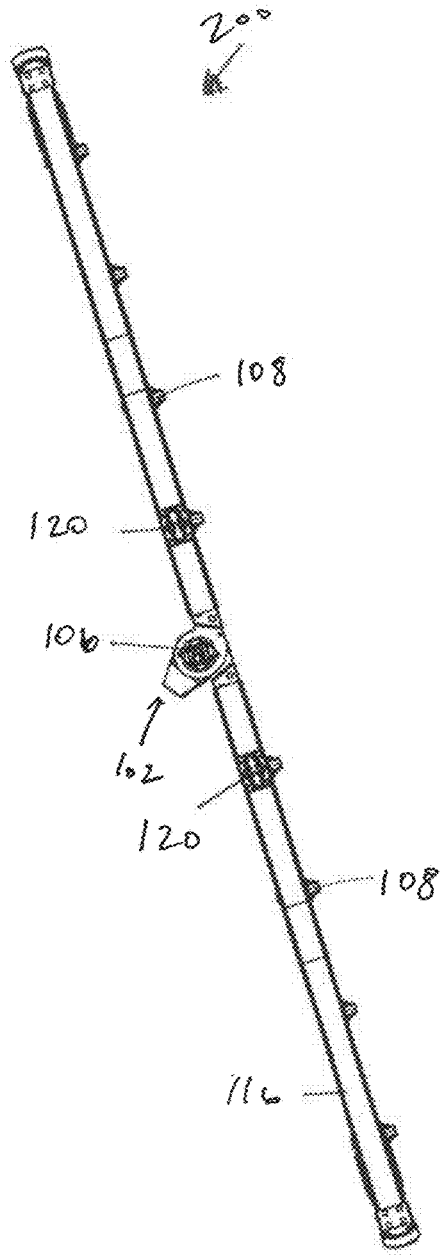
FIG. 17 is a side elevation view of the multi-position ladder according to the embodiment shown in FIG. 13
Figure 18:
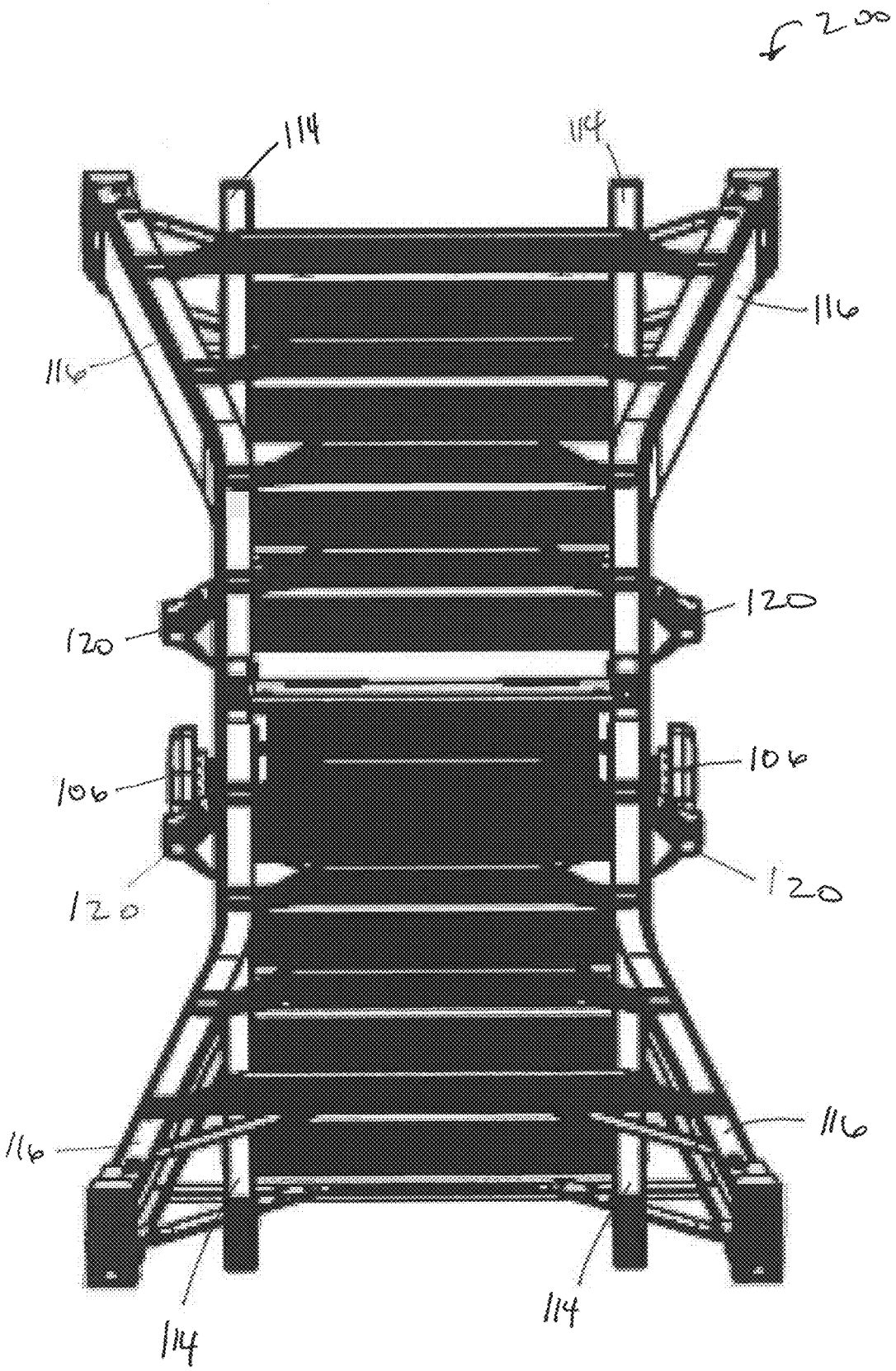
FIG. 18 is a top view of the multi-position ladder according to the embodiment shown in FIG. 13.

FIG. 1 provides an exemplary embodiment of the multi-position ladder in a stepladder position 100. As shown, two hinges 106 may be located opposite one another on either side of the legs 116. In the depicted embodiments, hinges 106 are positioned at the very top of stepladder 100 and generally in the middle of extension ladder 200 (see, e.g., FIG. 13). Hinges 106 generally comprise two hinge extensions 180 (see, e.g., FIG. 10) and an inside surface 190 (see, e.g., FIG. 8). Hinge extensions 180 are configured to fit within each leg 116, operably coupled to rails 114. Hinge extensions 180 may each include respective spacers 110.

A plurality of rungs 108 may be arranged at approximately equal distances along the legs 116, coupled to the inner surfaces of legs 116 and providing generally parallel, planar surfaces. Adjustable rail brackets 120 may be positioned along the outside of legs 116, generally positioned on the opposite side of legs 116 from each rung 108 that is closest to top cap 102.

Top cap 102 generally comprises a rigid frame 154 having two ends, each end coupled to respective inside surfaces 190 of hinges 106. Top cap 102 may include a utility or tool tray 128 and a step surface 160, with both tool tray 128 and step surface 160 presenting generally planar surfaces on opposing sides of top cap 102. When the multi-position ladder is in a stepladder position 100, tool tray 128 is oriented upward to provide a generally planar surface parallel to the rungs 108. When the multi-position ladder is in an extension position, step surface 160 may generally be oriented upward, positioned to provide a generally planar surface that is parallel to the rungs 108. In operation, step surface 160 can operate as an additional rung 108 between hinges 106.

As shown in FIGS. 1-6, stepladder 100 has an additional six inch reach in hinge spacing 104. The additional hinge spacing 104 is located between the hinges 106 and the adjustable rail brackets 120. As shown in FIGS. 13-18, extension ladder 200 has an additional twelve inch reach in hinge spacing 204. The additional hinge spacing 204 is located between the adjustable rail brackets 120. The top cap 102 provides a useful tool or material work surface at the top of stepladder 100. In embodiments, top cap 102 may be configured to be permanently affixed to a rigid frame 154 (shown in more detail in, for example, FIGS. 8-9) between hinges 106. Alternatively, top cap 102 may comprise removable or adjustable features, providing greater versatility to stepladder 100. Top cap 102 also provides an additional step or rung 108 for extension ladder 200. Rigid frame 154, described in more detail below, adds stiffness and strength to the ladder between hinges 106, improving the durability and safety of the multi-position ladder.

Figure 7:
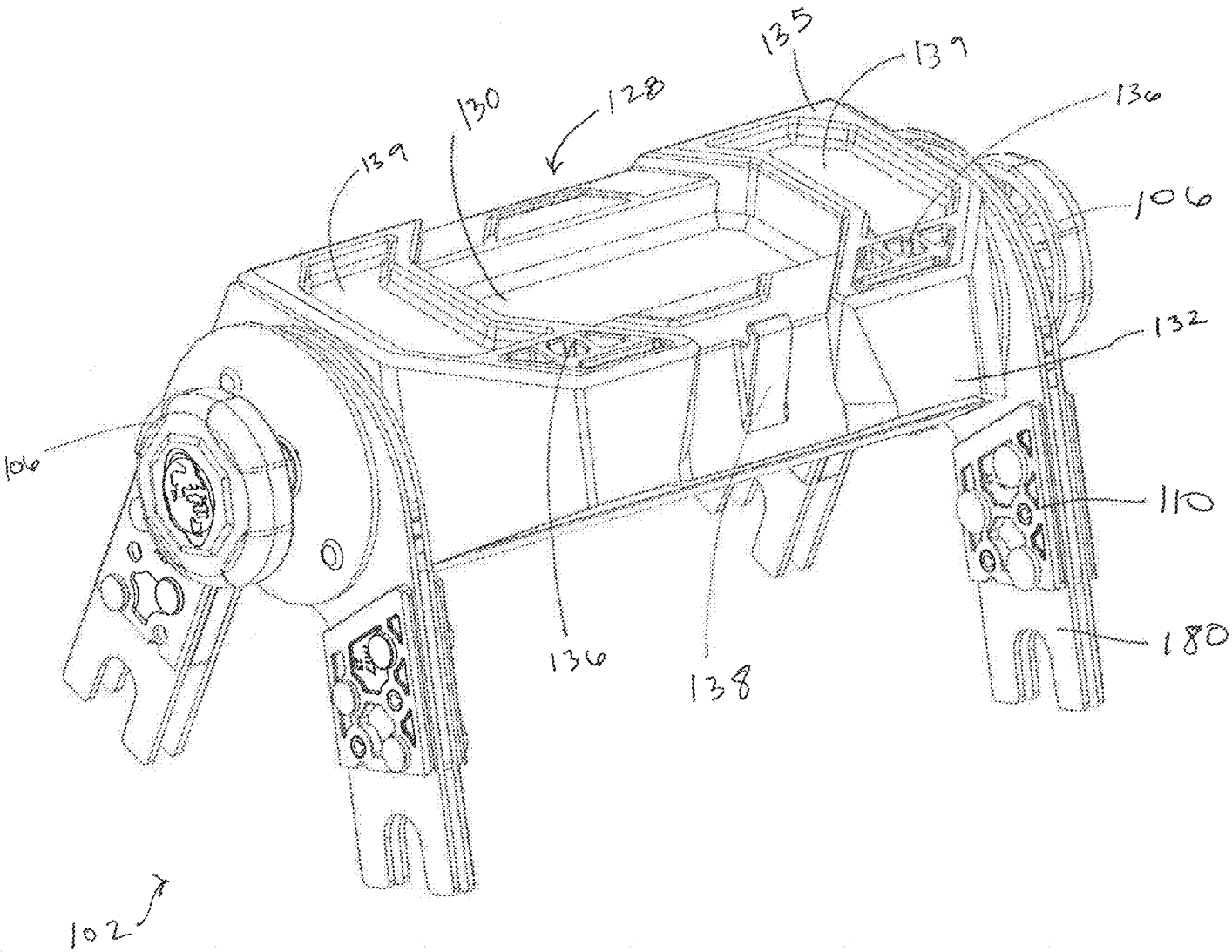
FIG. 7 is a perspective view of a top cap in stepladder position according to an embodiment of the invention.

Referring to FIG. 7, embodiments of top cap 102 can include tool tray 128 between hinges 106. Tool tray 128 has a generally planar top surface extending between hinges 106. When the multi-position ladder is in a stepladder position 100, tool tray 128 provides a generally planar surface that is parallel to the surfaces of the rungs 108. Tool tray 128 may be manufactured of any formable durable material such as metal, plastic, or fiberglass and has a planar top surface 135. Tool tray 128 may include a variety of features, and is generally configured to provide an operable surface at the top of stepladder 100. For example, tool tray 128 may include a main compartment 130 configured to receive large tools or provide a generally flat surface upon which materials or tools may rest while the stepladder 100 is in use. In embodiments, main compartment 130 may be large enough to receive a standard paint can, or designed to provide a recess for safely and securely holding items such as power tools or construction materials. Tool tray 128 may also include a plurality of recesses 139 in operable positions around main compartment 130. For example, tool tray 128 may include recesses 139 on either side of main compartment 130, configured to securely hold smaller work materials such as screws, nails, nuts, or bolts. Tool tray 138 may also include one or more apertures 136 configured to receive tools such as hammers or screwdrivers and hold them in an organized fashion at the top of stepladder 100.

For example, tool tray 128 may be coupled to a skirt 132 that may provide additional useful features for top cap 102. Skirt 132 may be permanently or removably attached to tool tray 132, extending perpendicularly from main compartment 130. Skirt 132 may include a variety of features, similarly to tool tray 128. For example, apertures 136 may be positioned on skirt 132 so that the handles of tools may extend below the rigid frame 154 between hinges 106. Skirt 132 may also include a handle or hanger 138 configured to securely hold paint cans, buckets, power tools, construction materials, or other items.

Figure 9:
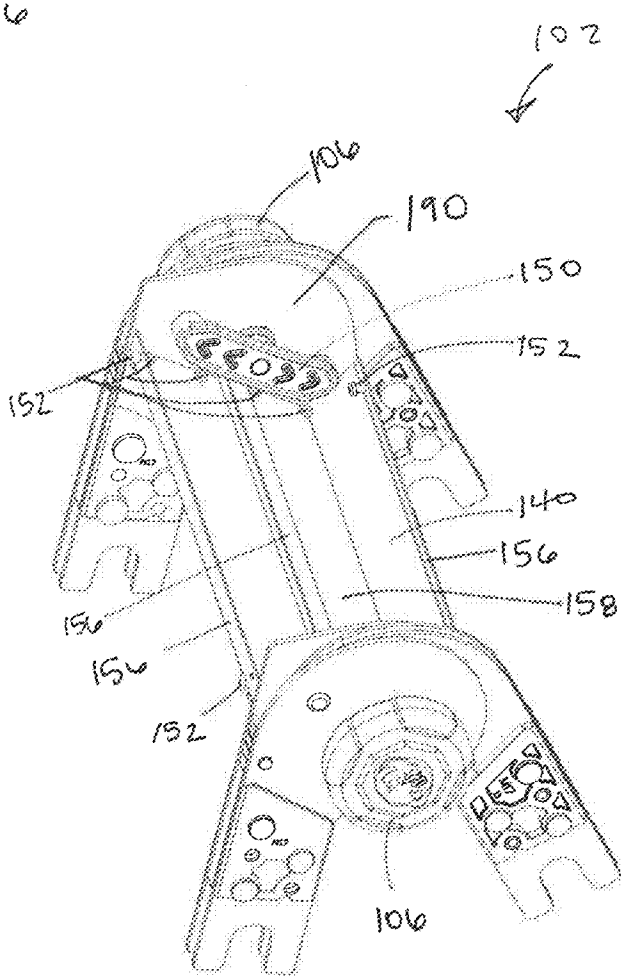
FIG. 9 is a perspective view of a top cap in stepladder position according to an embodiment of the invention.
Figure 8:
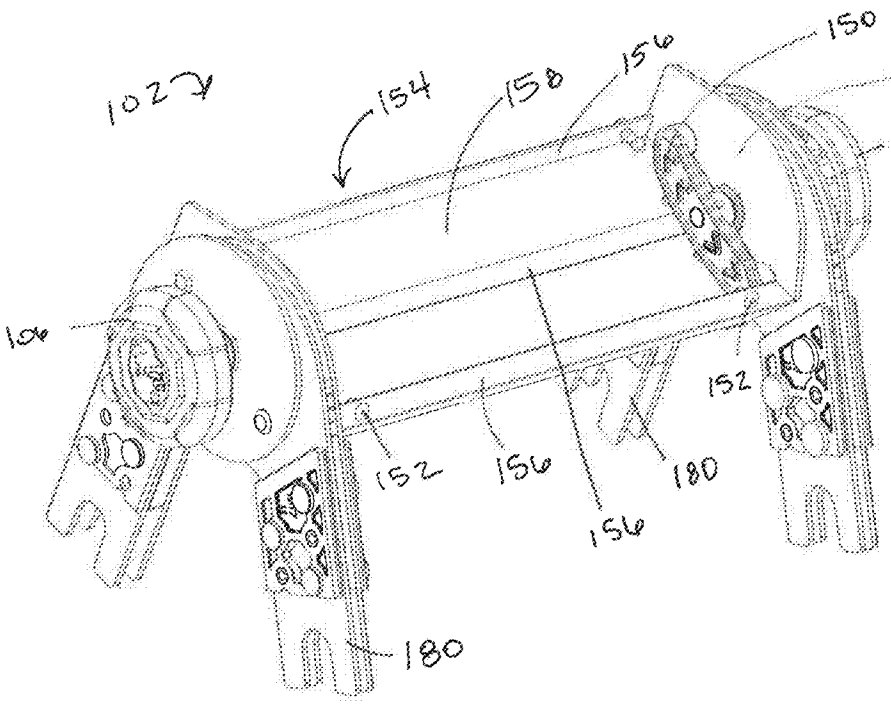
FIG. 8 is a perspective view of a top cap in stepladder position according to an embodiment of the invention.

Referring to FIGS. 8 and 9, the rigid frame 154 can be seen in more detail. In these figures, tool tray 128 is not shown. In embodiments, tool tray 128 may be coupled to rigid frame 154 by screws or rivets 152. Tool tray 128 may be permanently affixed or removably attached to rigid frame 154. For example, removing tool tray 128 could provide access to lock bracket 150, which may be useful for adjusting the multi-position ladder between a step ladder position 100 and an extension position 200 (see, for example, FIGS. 13-18). Alternatively, the multi-position ladder could be adjusted between the step ladder 100 and extension ladder 200 using the hinges 106. Such mechanisms are well known in the art, and need not be described in detail here.

As shown in FIGS. 8 and 9, a lock bracket 150 may be operably coupled to hinge 106 and rigid frame 154. Each hinge 106 may be coupled to a corresponding lock bracket 150 by a lock spring 112 or other hinge extension. Lock bracket 150 may be generally positioned proximate the inside surface 190 of hinges 106. Rigid frame 154 may extend between hinges 106 and lock brackets 150, designed to add stiffness to hinges 106, which can improve the strength of hinges 106 and the multi-position ladder itself. For example, rigid frame 154 may be riveted or welded to hinges 106. Alternatively, rigid frame 154 may be extruded or otherwise formed as part of hinges 106. Hinges 106 and lock bracket 150 are mechanisms which have been previously disclosed in the art. For example, US 2018/0274296 to Foley et al. ("Foley") discloses an adjustable hinge and lock mechanism for a multi-position ladder. Rigid frame 154 may be configured to operate with such known hinge and lock mechanisms, and may be designed to be permanently affixed to multi-position ladders using known materials and methods.

Figure 19:
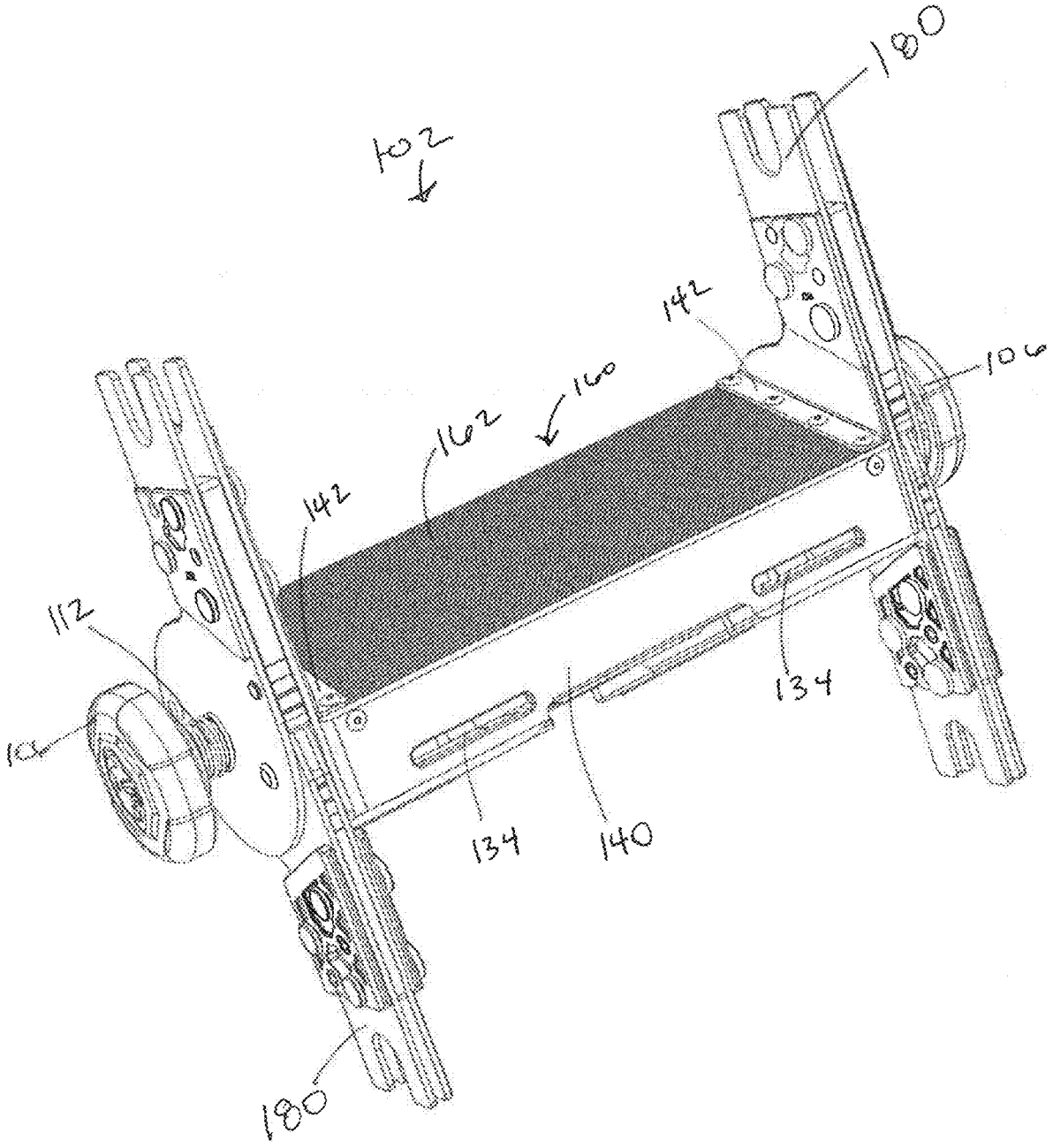
FIG. 19 is a perspective view of the top cap in extension position according to an embodiment of the invention.
Figure 20:
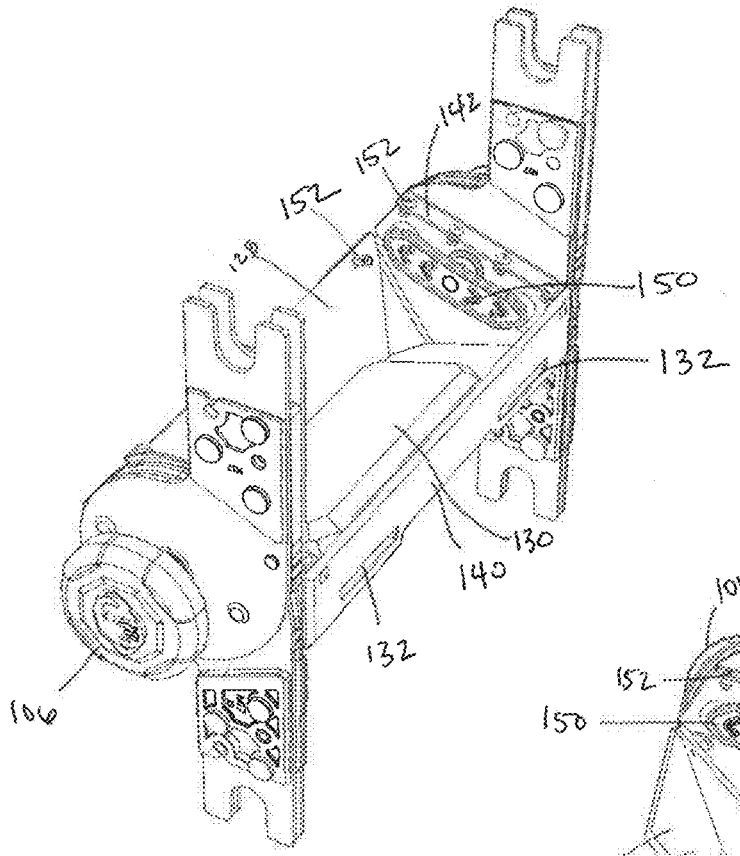
FIG. 20 is a perspective view of the top cap in extension position according to an embodiment of the invention.
Figure 21:
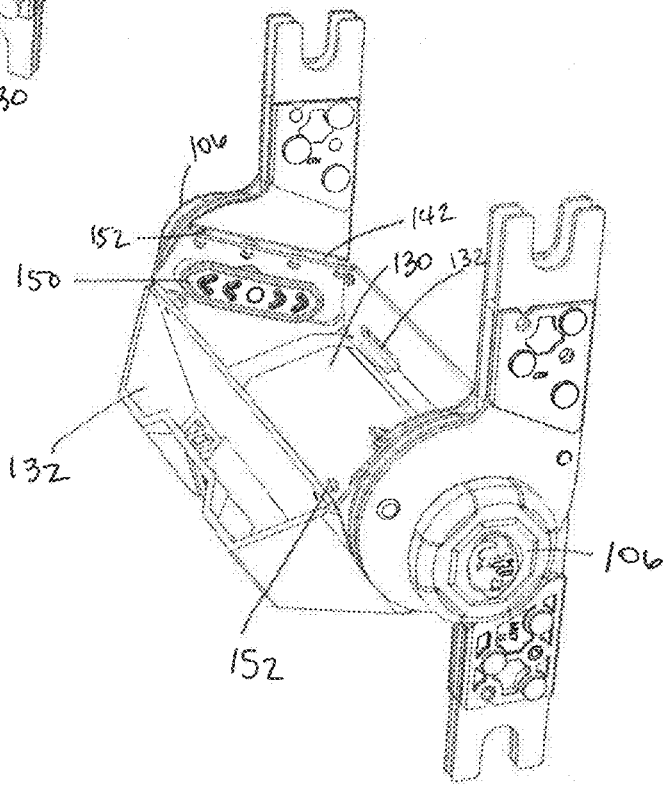
FIG. 21 is a perspective view of the top cap in extension position according to an embodiment of the invention.
Figure 22:
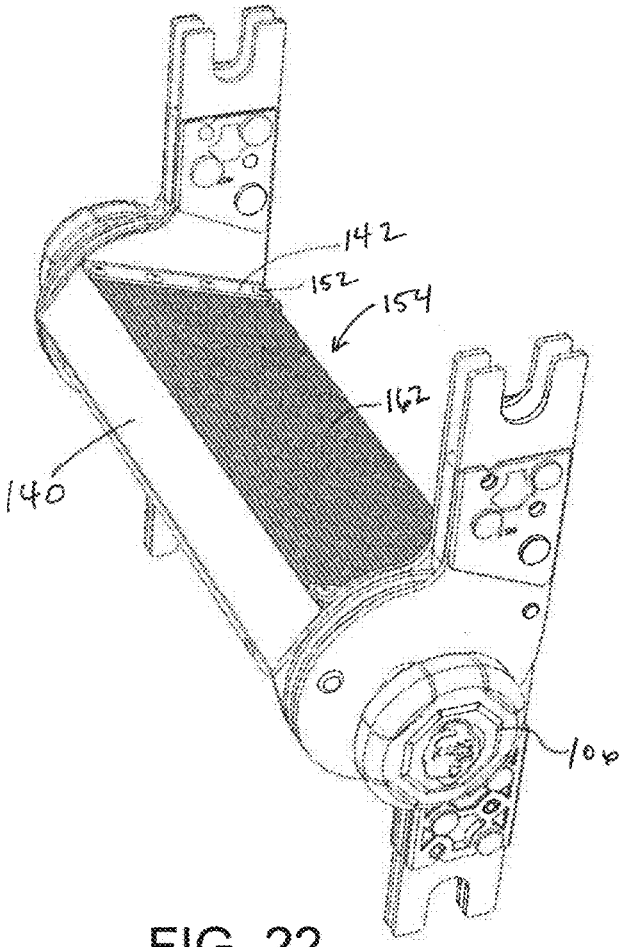
FIG. 22 is a perspective view of the top cap in extension position according to an embodiment of the invention.
Figure 23:
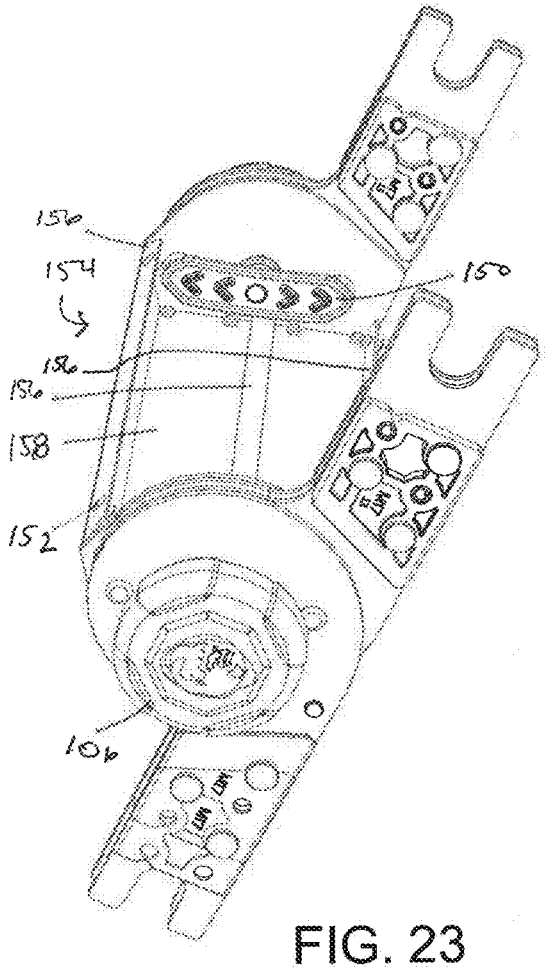
FIG. 23 is a perspective view of the top cap in extension mode according to an embodiment of the invention.
Figure 24:
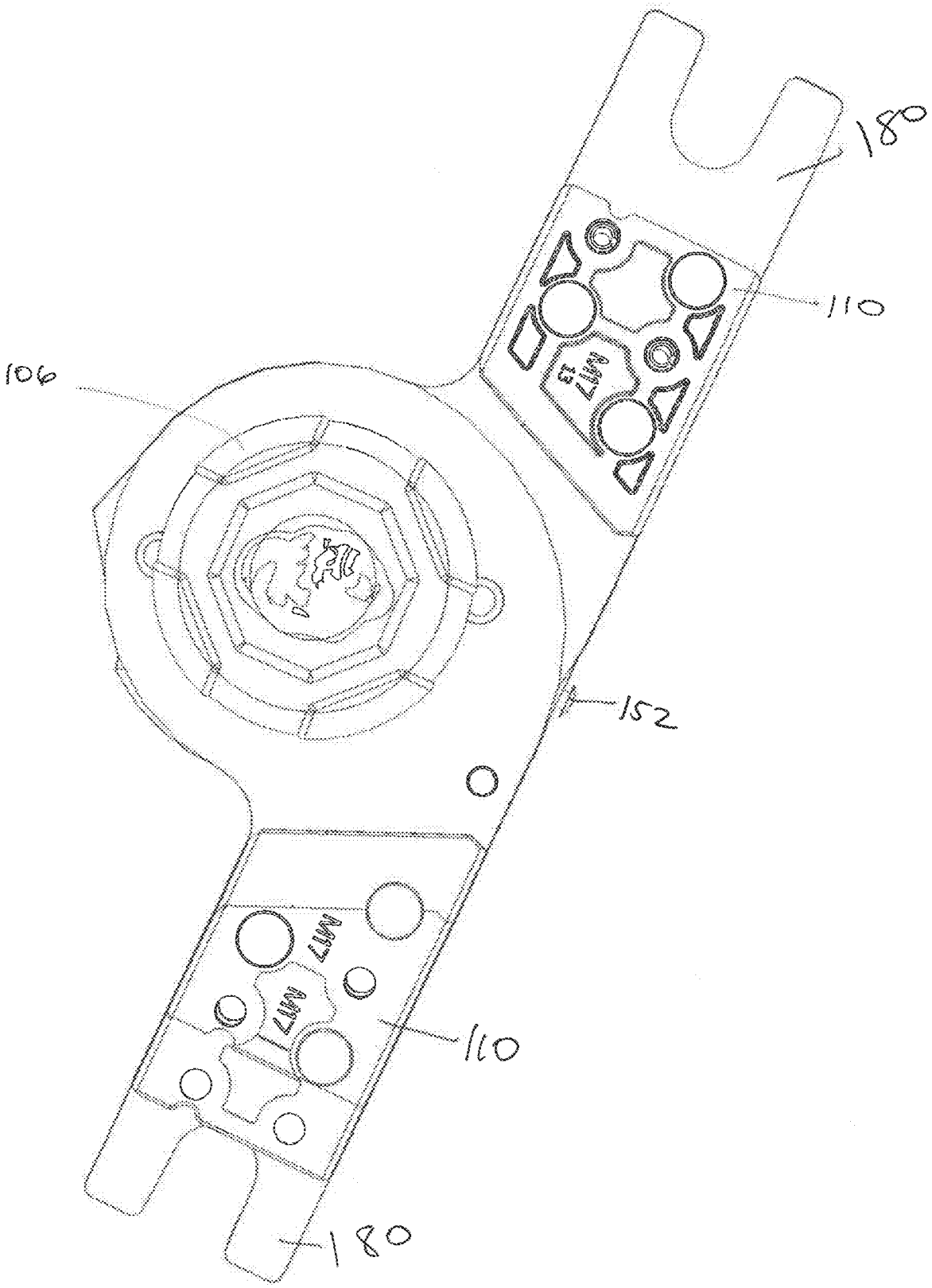
FIG. 24 is a side elevation view of the top cap in extension mode according to an embodiment of the invention.
Figure 25:
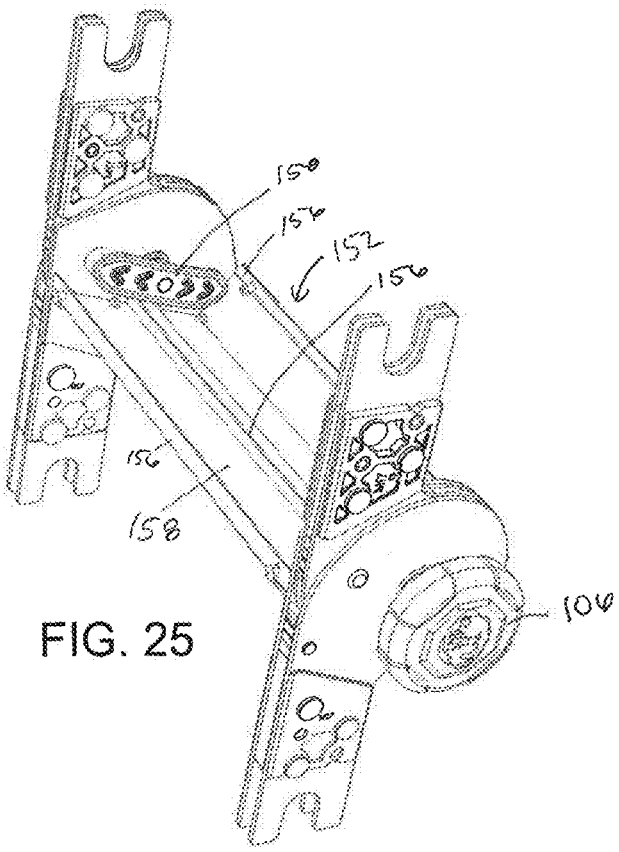
FIG. 25 is a perspective view of the top cap in extension mode according to an embodiment of the invention.
Figure 26:
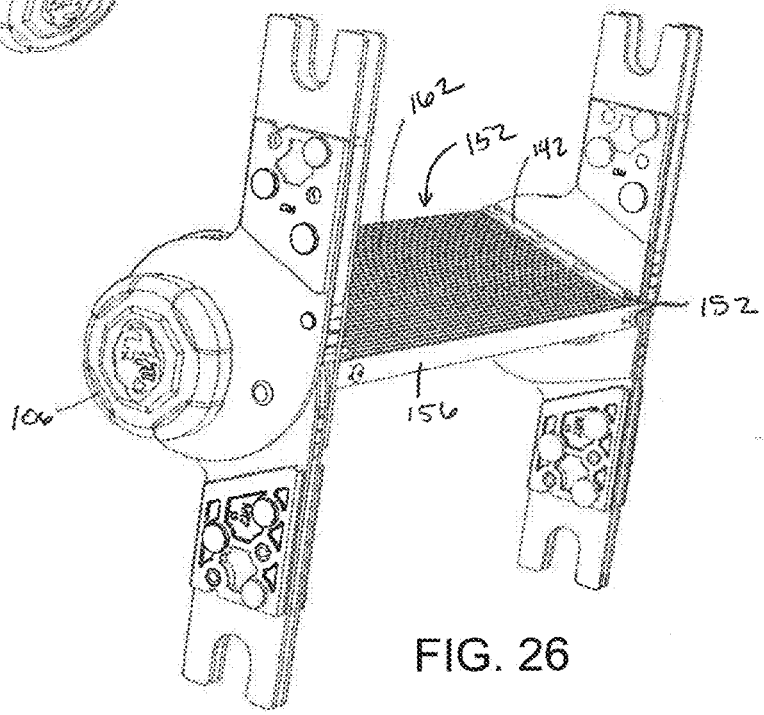
FIG. 26 is a perspective view of the top cap in extension mode according to an embodiment of the invention.

Rigid frame 154 may comprise one or more trusses 156 extending between hinges 106, coupled to a ledger 158 and hinges 106 by rivets 152. For example, frame 154 may comprise three trusses 156. Alternate numbers of trusses 156 may extend between hinges 106, but are configured to provide a stable, rigid surface that increases the stiffness between hinges 106. In exemplary embodiments, trusses 156 are coupled to ledger 158 and hinges 106 by alternative means, such as welding, or may be extruded or otherwise formed of a single piece. Ledger 158 may be positioned an adequate distance from lock bracket 150 to permit lock bracket 150 to rotate, or to permit a user's hand to grasp lock bracket 150 and push or pull lock bracket 150 when adjusting the position of the multi-position ladder. As shown in FIG. 9, rigid frame 154 may also comprise wall 140 extending transverse to ledger 158. Wall 140 may be coupled to rigid frame 154 by rivets 152. In alternative embodiments, wall 140 may be coupled by any removable or permanent means to rigid frame 154. Wall 140 increases the stiffness of rigid frame 154, and may be formed as part of the rigid frame 154 or as part of the tool tray 128. As shown in FIG. 19, alternative embodiments of top cap 102 may additionally include two walls 140, generally positioned on opposing sides of rigid frame 154, providing further features such as slits 134 for holding tools or materials at the top of stepladder 100 or in the mid-section of extension ladder 200.

Figure 10:
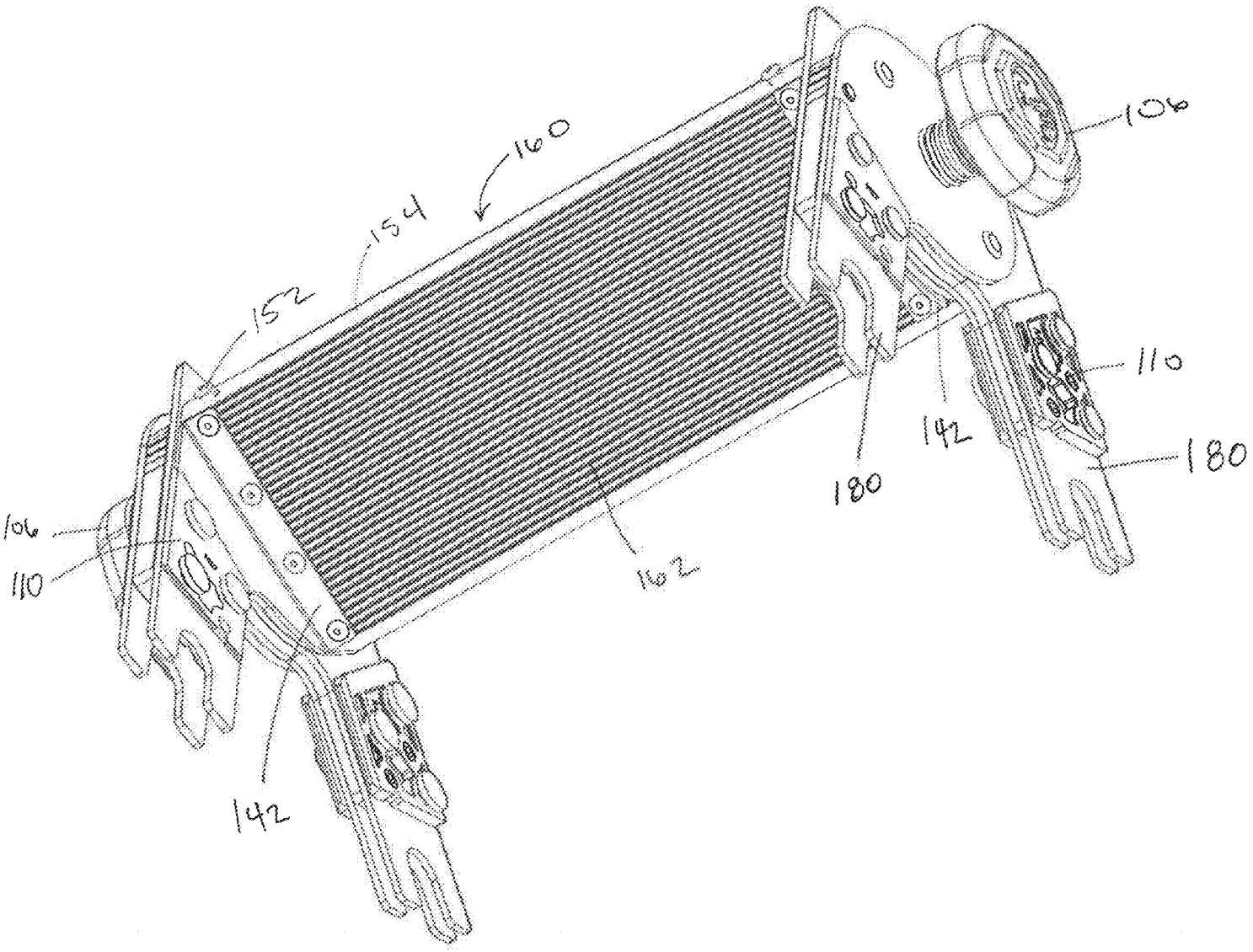
FIG. 10 is a perspective view of a top cap in stepladder position according to an embodiment of the invention.

FIG. 10 shows the under-side of rigid frame 154, which provides a step surface 160 when the ladder is in an extension position 200. Step surface 160 generally comprises a planar tread 162 extending between hinges 106 and attached to the inside surface 190 of each hinge 106 proximate each respective lock bracket 150. When the multi-position ladder is in an extension position 200 (see, e.g., FIGS. 13-26), tread 162 of step surface 160 provides a generally flat surface parallel to the surfaces of rungs 106. For example, embodiments of rigid frame 154 may comprise step surface 160 that extends between hinges 106 and two beams 142 at each edge of step surface 160 configured to attach step surface 160 to hinges 106 by a plurality of rivets 152. Beams 142 may provide additional strength and stiffness to rigid frame 154. Step surface 160 may additionally include tread 162 or other material designed to increase friction and improve the safety of step surface 160. Alternative embodiments do not include tread 162 on top of step surface 160.

Figure 11:
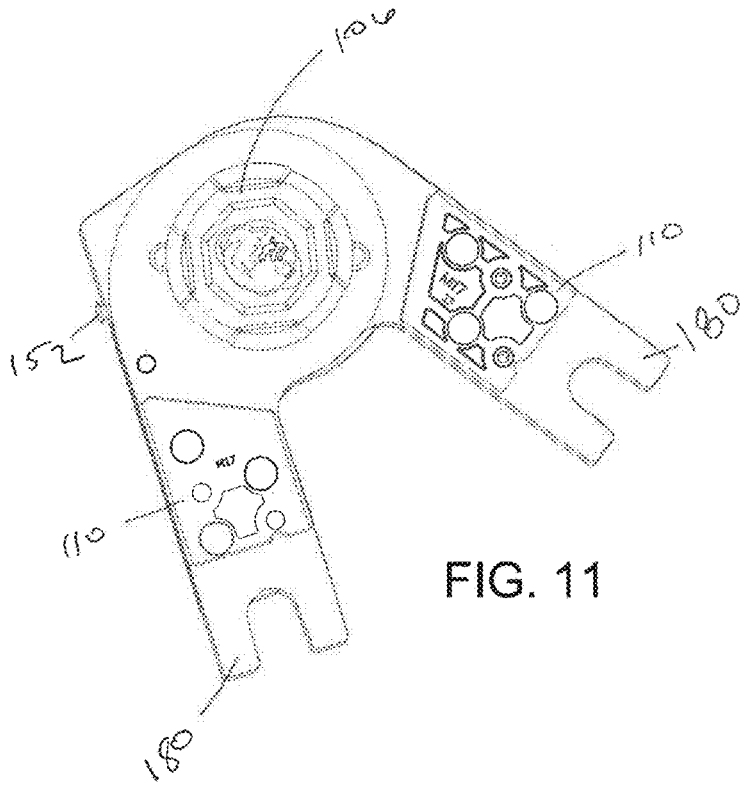
FIG. 11 is a side elevation view of top cap in stepladder position according to an embodiment of the invention.

FIG. 11 provides a side view of hinges 106, located on each side of stepladder 100. Such hinges 106 for multi-position ladders may include spacers 110 on each of the legs, as described by the Foley application. In preferred embodiments, rivets 152 can be used to attach top cap 102 to the stepladder 100 or extension ladder 200 proximate hinges 106. Alternatively, portions of top cap 102 may be removably attached by screws, pins or other known means, or may be permanently attached to hinges 106.

Figure 12:
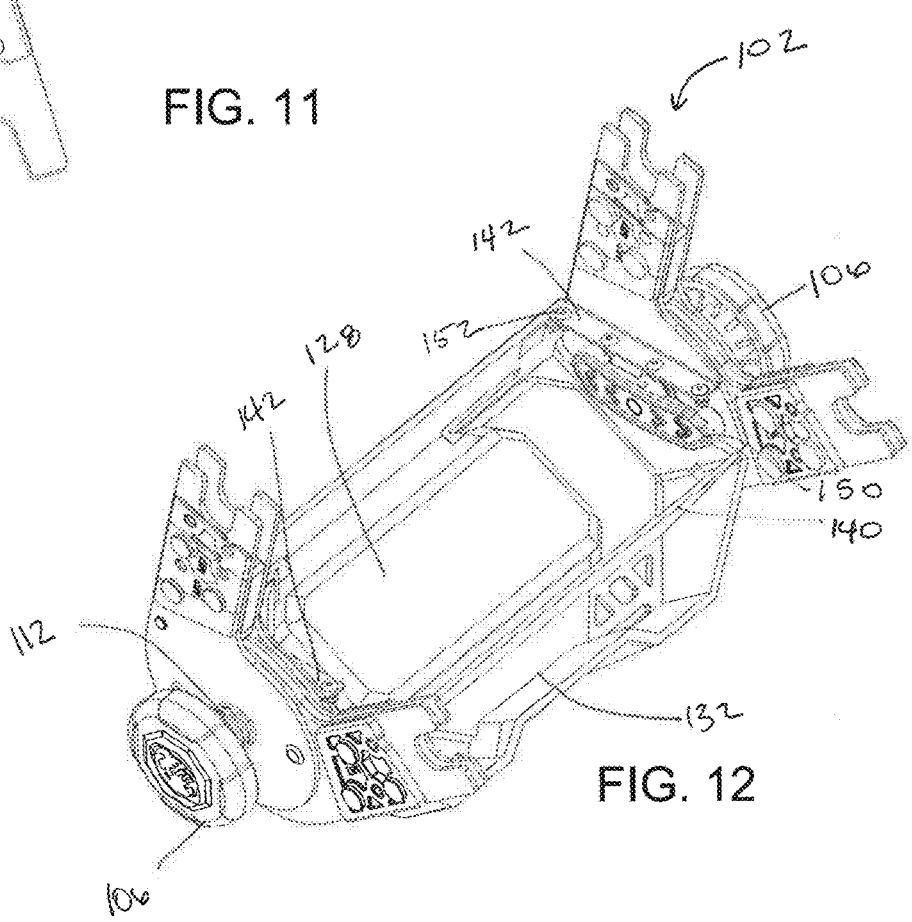
FIG. 12 is as perspective view of a top cap in stepladder position according to an embodiment of the invention.

For example, FIG. 12 shows top cap 102 with step surface 160 removed. The under-side of tool tray 128 is shown, including skirt 132 coupled to tool tray 128 by rivets 152 that extend through wall 140. As shown, such an embodiment includes a beam 142 located at either side of top cap 102 proximate hinges 106 and lock brackets 150. Beams 142 may be oriented transversely from wall 140, and configured to add rigidity and attach tool tray 128 to hinges 106 with a plurality of rivets 152. Hinges 106 may be designed to permit a user to twist or pull on the hinges 106, extending a lock spring 112 that couples hinges 106 to the lock bracket 150. Alternative hinges configured to adjust a multi-position ladder may also be used, according to the embodiments of the present disclosure.

FIGS. 13-18 show embodiments of a multi-position ladder that includes top cap 102 and is positioned in an extension position 200. As shown, top cap 102 may be positioned between the central hinges 106 of extension ladder 200. Top cap 102 may be designed to allow 12-inch hinge spacing 204 between adjustable rail brackets 120, adding a foot of reach to extension ladder 200. In these embodiments, top cap 102 may be oriented within extension ladder 200 such that step surface 160 can provide an additional step, or rung 108, to extension ladder 200. In this orientation, tool tray 128 is generally upside down, on the opposing side of top cap 102 from step surface 160.

FIGS. 19-26 provide more detailed views of top cap 102 in an orientation that provides optimal use for step surface 160 for use with a multi-position ladder in an extension position 200. These figures conform to the description provided above for FIGS. 7-12, so a duplicate description will not be provided.

It should be understood that the various components disclosed in the drawings and descriptions may be substituted with equivalent components (e.g., the components can be constructed of metal, plastic, fiberglass, and other similar materials or combinations thereof) and are not to be considered limiting. For example, top cap 102 may be formed of a single material, such as plastic or aluminum. Alternatively, top cap 102 may be formed from a combination of materials. In such embodiments, for example, rigid frame 154 and step surface 160 may be formed of aluminum while tool tray 128 may be formed of a different material such as plastic. In preferred embodiments, step surface 160 may be connected to hinges 106 on each side of the multi-position ladder to add stiffness to the hinges 106 and ladder 100, 200, while providing a step when the multi-position ladder is in an extension position 200. Preferred embodiments also contemplate that tool tray 128 be attached to the step surface 160 by rivets 152, but other attachment mechanisms known in the art may also be used. For example, the entirety of top cap 102 may be formed of a single material, such that tool tray 128 and step surface 160 comprise a single, permanently coupled article. In embodiments, step surface 160 can be riveted or welded to hinges 106, but alternative embodiments comprise step surface 160 that is extruded or otherwise formed as part of hinges 106.

It should be understood that the individual steps used in the methods of the present teachings may be performed in any order and/or simultaneously, as long as the teaching remains operable. Furthermore, it should be understood that the apparatus and methods of the present teachings can include any number, or all, of the described embodiments, as long as the teaching remains operable.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

We claim:

1. A top cap for a multi-position ladder comprising:

a tread having two ends, each tread end directly mounted to one of a pair of ladder hinges wherein each hinge has a pair of hinge extensions, the tread having a tread planar surface; and a utility tray operably connectable to the tread, the utility tray having a planar top surface; wherein the top cap has a ladder extension position wherein, in the ladder extension position each respective pair of the hinge extensions of the pair of ladder hinges are inline; wherein, in the ladder extension position the tread planar surface of the tread faces upward and the planar top surface of the utility tray faces downward; and wherein the top cap has a stepladder position; wherein in the stepladder position each respective pair of the hinge extensions of the pair of ladder hinges form an angle between 10 and 45 degrees; and wherein in the stepladder position the planar top surface of the utility tray faces upward and the tread planar surface of the tread faces downward.

2. The top cap for a multi-position ladder of claim 1 wherein the tread is manufactured from an alloy of aluminum.

3. The top cap for a multi-position ladder of claim 2 wherein the utility tray is manufactured from a synthetic polymer.

4. The top cap for a multi-position ladder of claim 3 wherein the utility tray is operably removable from the top cap.

5. The top cap for a multi-position ladder of claim 2 wherein each tread end is riveted to its respective hinge.

6. The top cap for a multi-position ladder of claim 5 wherein the utility tray is operably removable from the top cap.

7. The top cap for a multi-position ladder of claim 6 wherein the utility tray is manufactured from a synthetic polymer.

8. The multi-position ladder of claim 1 wherein each tread end is welded to its respective hinge.

9. The top cap for a multi-position ladder of claim 1 wherein the tread and utility tray planar top surface are non-coplanar.

10. The top cap for a multi-position ladder of claim 1 wherein the ladder hinges and the tread are unibody.

11. A multi-position ladder comprising:

two hinges each hinge having a pair of hinge extensions and an inside surface;

two pairs of rails, each pair of rails matedly attached to a respective hinge;

a plurality of rungs being attached between each pair of rails, each rung having a step surface;

wherein the multi-position ladder is configured to be movable between an extension position and a stepladder position, wherein in the extension position each respective pair of the hinge extensions of the two hinges are inline; and wherein in the extension stepladder position each respective pair of the hinge extensions of the two hinges form an angle of less than 180 degrees and more than zero degrees;

a ladder top cap comprising:

a planar tread having two ends, each tread end directly attached to a respective hinge inside surface, the tread having a tread planar surface; and a utility tray operably connectable to the tread, the utility tray having a planar top surface;

wherein when the multi-position ladder is in the extension position, the tread planar surface is generally parallel to the step surface of the rungs and the planar top surface of the utility tray is facing downward; and when the multi-position ladder is in the stepladder position the planar top surface of the utility tray is generally parallel to the step surface of the rungs and the tread planar surface of the tread is facing downward.

12. The multi-position ladder of claim 11 wherein the planar tread is manufactured from an alloy of aluminum.

13. The multi-position ladder of claim 12 wherein the utility tray is manufactured from a synthetic polymer.

14. The multi-position ladder of claim 11 wherein the utility tray is operably removable from the ladder top cap.

15. The multi-position ladder of claim 11 wherein each tread end is riveted to its respective hinge inside surface.

16. The multi-position ladder of claim 11 wherein each tread end is welded to its respective hinge inside surface.

17. A multi-position ladder comprising:

two hinges each hinge having a pair of hinge extensions and an inside surface;

two pairs of rails, each pair of rails matedly attached to a respective hinge;

a plurality of rungs being attached between each pair of rails, each rung having a step surface;

wherein the multi-position ladder is configured to be movable between an extension position and a stepladder position, wherein in the extension position each respective pair of the hinge extensions of the two hinges are inline; and wherein in the extension stepladder position each respective pair of the hinge extensions of the two hinges form an angle between 10 and 45 degrees;

a ladder top cap comprising:

a step having two ends, each step end directly attached to a respective hinge inside surface, the step having a step planar surface; and a utility tray operably connectable to the step, the utility tray having a planar top surface;

wherein when the multi-position ladder is in the extension position, the step planar surface is generally parallel to the step surface of the rungs and the planar top surface of the utility tray is facing downward; and when the multi-position ladder is in the stepladder position the planar top surface of the utility tray is generally parallel to the step surface of the rungs and the step planar surface of the tread is facing downward.

18. The multi-position ladder of claim 17 wherein the step is manufactured from an alloy of aluminum.

19. The multi-position ladder of claim 18 wherein the utility tray is operably removable from the ladder top cap.

20. The multi-position ladder of claim 18 wherein each step end is riveted to its respective hinge inside surface.

* * * * *